US005460933A

United States Patent [19]

Brick et al.

[11] Patent Number: 5,460,933

[45] Date of Patent: Oct. 24, 1995

[54] PHOTOGRAPHIC ELEMENT HAVING SOLID PARTICLE DISPERSION OF OXIDIZED DEVELOPER SCAVENGER

[75] Inventors: Mary C. Brick; Norma B. Platt, both of Webster; Paul L. Zengerle; Jeffery L. Hall, both of Rochester, all of N.Y.

[73] Assignee: Eastman Kodak Company, Rochester, N.Y.

[21] Appl. No.: 198,239

[22] Filed: Feb. 18, 1994

Related U.S. Application Data

[63] Continuation-in-part of Ser. No. 52,599, Apr. 22, 1993, abandoned.

[51] Int. Cl.[6] ..... G03C 1/43; G03C 7/392

[52] U.S. Cl. ..... 430/566; 430/214; 430/505; 430/551; 430/631

[58] Field of Search ..... 430/214, 551, 430/566, 216, 505, 631

[56] References Cited

U.S. PATENT DOCUMENTS

| | | | |
|---|---|---|---|
| 2,983,606 | 5/1961 | Rogers | 430/215 |
| 3,008,657 | 11/1961 | Szegvari | 241/170 |
| 3,075,710 | 1/1963 | Feld et al. | 241/16 |
| 3,149,789 | 9/1964 | Szegvari | 241/27 |
| 4,006,025 | 2/1977 | Swank et al. | 96/129 |
| 4,205,987 | 6/1980 | Erikson et al. | 430/216 |
| 4,326,806 | 12/1982 | Whitmore | 430/202 |
| 4,447,523 | 5/1984 | Ross et al. | 430/505 |
| 4,525,451 | 6/1985 | Ohki et al. | 430/551 |
| 4,530,889 | 7/1985 | Ohki et al. | 430/551 |
| 4,542,092 | 9/1985 | Toya et al. | 430/551 |
| 4,575,481 | 3/1986 | Takahashi et al. | 430/214 |
| 4,923,787 | 5/1990 | Harder | 430/551 |
| 5,230,992 | 7/1993 | Miyahashi et al. | 430/551 |
| 5,254,433 | 10/1993 | Nakamura et al. | 430/216 |
| 5,300,394 | 4/1994 | Miller et al. | 430/551 |

FOREIGN PATENT DOCUMENTS

| | | | |
|---|---|---|---|
| 320821 | 12/1988 | European Pat. Off. | G03C 7/26 |
| 59/222836 | 5/1983 | Japan | G03C 7/26 |
| 62103634 | 10/1985 | Japan | G03C 1/06 |
| 62100750 | 10/1985 | Japan | G03C 7/26 |
| 1570362 | 3/1977 | United Kingdom | G03C 1/02 |

OTHER PUBLICATIONS

Research Disclosure No. 17643, Dec. 1978, *Photographic Silver Halide Emulsions, Preparations, Addenda, Processing and Systems,* J. W. Carpenter, pp. 22–32.

Research Disclosure No. 18169, *A Color Diffusion Transfer Photographic Product,* May 1979, pp. 228–229.

Research Disclosure No. 34390, Nov. 1992, *Photographic Light–Sensitive Silver Halide Film Can Comprise A Transparent Magnetic Recording Layer, Usually Provided On The Backside Of The Photographic Support,* pp. 869–874.

*Primary Examiner*—Richard L. Schilling

*Attorney, Agent, or Firm*—Andrew J. Anderson

[57] ABSTRACT

Undesirable particle growth of particles comprising a hydrazide oxidized developer in a photographic dispersion can be significantly reduced when the hydrazide scavenger is in the form of a dispersion of crystalline solid particles dispersed in an aqueous medium. The dispersion is prepared by milling crystalline solid particles of the scavenger in an aqueous medium in the presence of a dispersing agent and in the substantial absence of an organic solvent.

6 Claims, No Drawings

PHOTOGRAPHIC ELEMENT HAVING SOLID PARTICLE DISPERSION OF OXIDIZED DEVELOPER SCAVENGER

BACKGROUND OF THE INVENTION

This application is a continuation in part of application Ser. No. 08/052,599 filed Apr. 22, 1993, now abandoned, the entire disclosure of which is incorporated herein by reference.

This invention relates to the use of hydrazide oxidized developer scavengers in photographic elements.

It is known in the art to add scavengers for oxidized developing agents to photographic elements to allow the scavenger to interact with the oxidized developing agent and prevent unwanted reaction between oxidized developer and components of the photographic element. Included among the scavengers for oxidized developing agent known in the art are hydrazide derivatives disclosed in U.S. Pat. No. 4,923,787 to Harder. These patents disclose using these scavengers as oil-in-water dispersions which are prepared by dissolving the scavenger in a high boiling organic solvent and then dispersing the resulting solution in an aqueous gelatin medium using mechanical means to obtain fine droplets.

PROBLEM TO BE SOLVED THE INVENTION

It has been found that when hydrazide oxidized developer scavengers are used to prepare a photographic element as an oil-in-water dispersion, the scavenger particles can undergo undesirable particle growth when the dispersion is held in a coating melt. We have discovered that this undesirable particle growth can be significantly reduced when the hydrazide scavenger is used in the form of an aqueous dispersion of crystalline solid particles consisting essentially of the hydrazide scavenger and the dispersion is prepared without the aid of an organic solvent.

SUMMARY OF THE INVENTION

One aspect of this invention comprises a photographic element comprising a support having thereon at least one silver halide emulsion layer, and a layer, which is the same or different from the silver halide layer, comprising crystalline solid particles consisting essentially of a hydrazide oxidized developer scavenger dispersed in a binder.

Another aspect of this invention comprises a process for preparing a crystalline solid particle dispersion of a hydrazide oxidized developer scavenger, comprising the steps of:

(a) milling crystalline solid particles of the hydrazide oxidized developer scavenger in an aqueous medium in the presence of a dispersing agent and in the substantial absence of an organic solvent to form a first dispersion; and (b) adding the first dispersion to an aqueous medium comprising a binder to form a second dispersion.

A further aspect of this invention comprises a process for preparing a photographic element which comprises the steps of:

(a) milling crystalline solid particles of a hydrazide oxidized developer scavenger in an aqueous medium in the presence of a dispersing agent and in the substantial absence of an organic solvent to form a first dispersion;

(b) adding the first dispersion to an aqueous medium comprising a binder to form a second dispersion; and (c) coating the second dispersion onto a support.

ADVANTAGEOUS EFFECT OF THE INVENTION

This invention provides a way of improving the utilization of hydrazide oxidized developer scavengers. The stability of the oxidized developer scavenger dispersion during melt coating operations is improved when the hydrazide is in the form of a crystalline solid particle dispersion.

As noted above, the prior art teaches that hydrazide oxidized developer scavengers are used as conventional oil-in-water dispersions, and their use in the form of crystalline solid particle dispersions has not, up to now, been described or suggested.

It was previously disclosed in U.S. Pat. No. 4,927,744 to Henzel et al that hydroquinone derivative oxidized developer scavengers incorporated in a photographic element in the form of conventional oil-in-water dispersions suffer from oxidative instability which is reduced if the hydroquinone is incorporated in the form of a crystalline solid particle dispersion. Hydrazide derivative oxidized developer scavengers do not suffer from oxidative instability when dispersed as conventional oil-in-water dispersions.

DETAILED DESCRIPTION OF THE INVENTION

The hydrazide oxidized developer scavengers useful in the practice of the present invention are well known and can be prepared by synthesis techniques known in the art. Preferred hydrazide scavengers are of the general formula

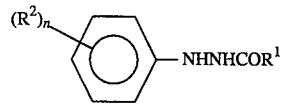

wherein:

$R^1$ represents an electron donating group;

$R^2$ represents a hydrogen atom or an alkyl, alkoxy, aryl, aryloxy, aralkyl or amino group; and n is an integer from 1 to 5.

A more detailed description of these hydrazide derivatives can be found in U.S. Pat. No. 4,923,787 to Harder, the entire disclosure of which is incorporated herein by reference.

Particularly preferred hydrazide scavengers are compounds of the formula:

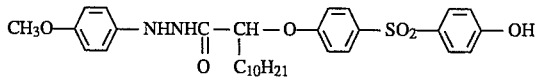

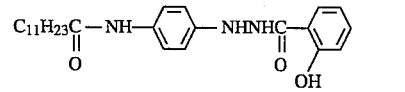

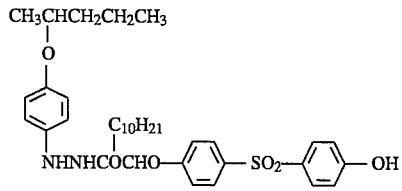

-continued

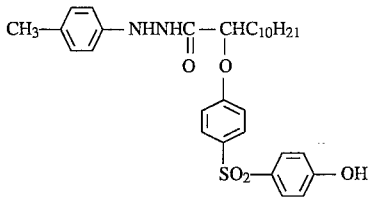

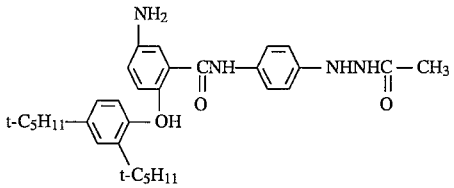

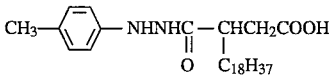

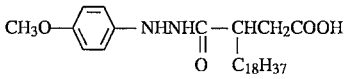

and

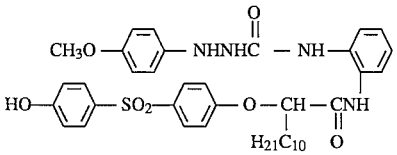

The scavenger compounds should be crystalline solids and substantially water insoluble at coating conditions, which generally involve temperatures from 10° C. to 50° C., and pH from 5.0 to 7.0. The crystalline solid particle dispersion can be formed by precipitating or reprecipitating the compound in the form of a dispersion in the presence of one or more dispersing agents, or by well known milling techniques. Reprecipitating techniques which involve dissolving the scavenger and precipitating by changing the solvent and/or pH in the presence of a dispersing agent are well known in the art. Reprecipitating techniques are described, for example, in U.S. application Ser. No. 07/812,503 by Texter, et al, filed Dec. 20, 1991, and are herein incorporated by reference. Milling techniques are also well known in the art, and examples include ball milling, media milling, attritor milling, jet milling or colloid milling the scavenger in the presence of a dispersing agent. The dispersing agent is preferably an anionic, nonionic or zwitterionic surfactant, or a water soluble homopolymer or copolymer. Mixtures of two or more dispersing agents can be used in the practice of this invention. The total amount of dispersing agent can vary over a wide range, generally from about 1% to about 200%, preferably about 5% to about 100%, the percentages being by weight, based on the weight of the scavenger.

Particularly preferred dispersing agents are an alkali metal salt of an alkarylene sulfonic acid, such as the sodium salt of dodecyl benzene sulfonic acid, the sodium salt of isopropylnaphthalene sulfonic acid or a mixture of monomers, dimers, trimers and tetramers of the sodium salt of isopropylnaphthalene sulfonic acid; an alkali metal salt of an alkyl sulfuric acid, such as sodium decyl sulfate or sodium dodecyl sulfate; or an alkali metal salt of an alkyl sulfosuccinate, such as sodium bis(2-ethylthexyl)succinic sulfonate, diethylpentyl sodium sulfosuccinate, dimethylpentyl sodium sulfosuccinate.

Examples of specifically preferred dispersing agents are:

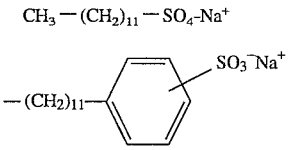

DA-1

DA-2

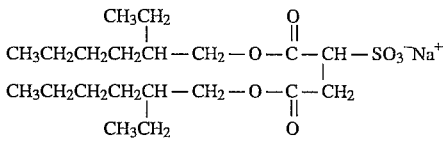

DA-3

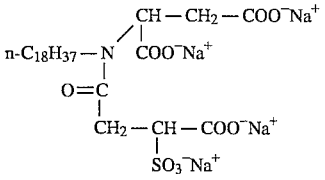

DA-4

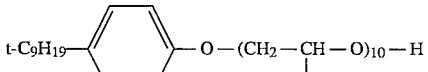

DA-5

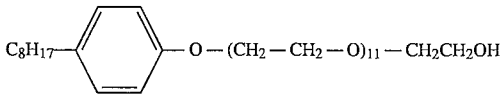

DA-6

DA-7

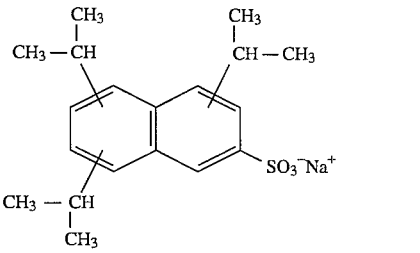

DA-8

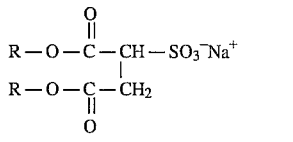

DA-9 where R = $-CH(CH_3)C_4H_9$

DA-10 where R = $-CH_2-CH_2-$

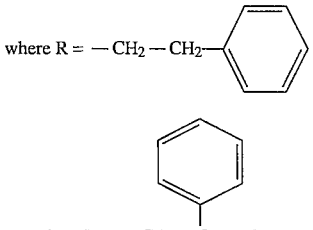

DA-11 where R = $-CH_2-CH-CH_3$ where R = $-CH_2-CH(CH_2CH_3)C_3H_7$ DA-12 where R = $-(CH_2)_nCH_3$ (n = 2, 3&5) DA-13

-continued

DA-14

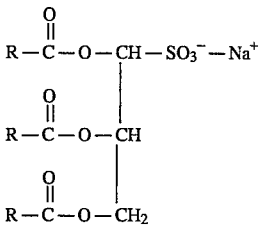

where R = —$(CH_2)_n$— (n = 2–5)

DA-15

$n\text{-}C_{12}H_{25}-O-(CH_2-CH_2-O)_{22}-CH_2CH_2OH$

DA-16

$C_{12}H_{25}-O-(CH_2-CH_2-O)_{15}-CH_2-CH_2-SO_3^--Na^+$

DA-17

$n\text{-}C_{12}H_{25}-O-(CH_2-CH_2-O)_n-C(=O)-CH_2-SO_3^-Na^+$, $CH_2-COO^-Na^+$ n = 3–5

DA-18

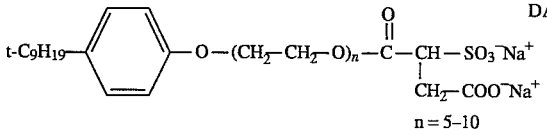

n = 5–10

DA-19

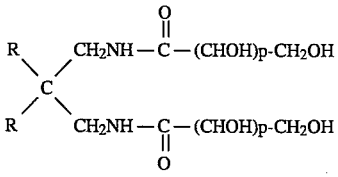

where p = 3 to 10 where, R = n-$CH_3-(CH_2)_x$— (where x = 3–10)

DA-20

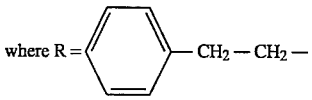

DA-21

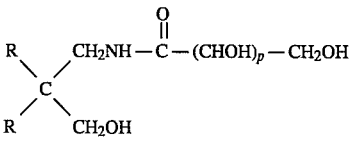

where, R = n-$CH_3-(CH_2)_x$—

(where x = 3 to 10
p = 3 to 15)

DA-22

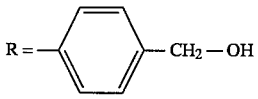

DA-23

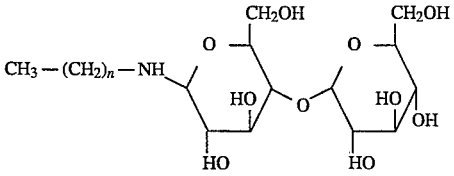

where, n = 3 to 15

-continued

DA-24

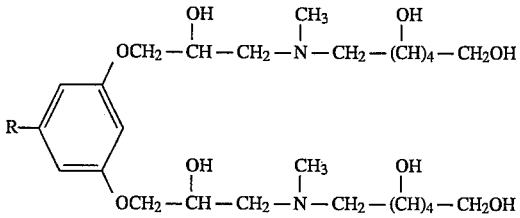

where R=$CH_3-(CH_2)_x$—
(where, x = 1 to 5)

DA-25

$CH_3-(CH_2)_n-O-CH_2-CH(OH)-CH_2-NH-C(=O)-(CHOH)_4CH_2OH$ where n = 3 to 15

DA-26

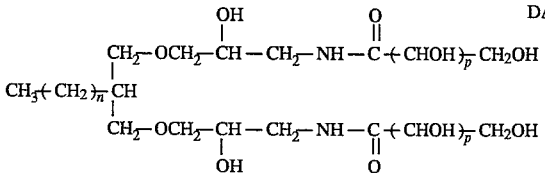

where, n = 2 to 12
p = 3 to 10

DA-27

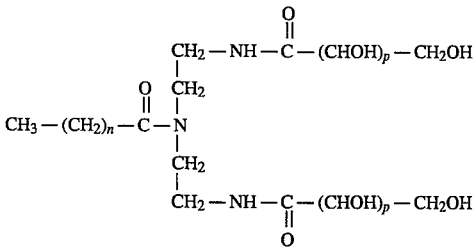

where, n = 2 to 18
p = 3 to 10

DA-28

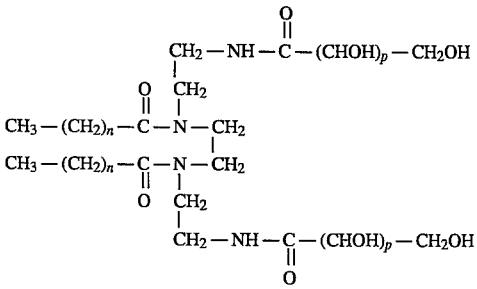

where, n = 2 to 18
p = 3 to 10

DA-29

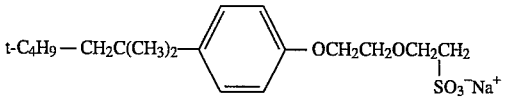

DA-30

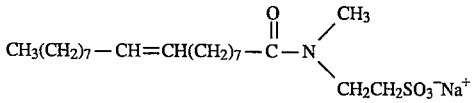

-continued

DA-31

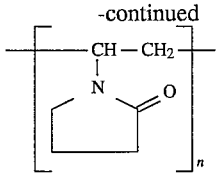

polyvinylpyrrolidone

If milling media is used to prepare the dispersion, the mill is charged with the media such as, for example, spheres of silica, sand, zirconium oxide, zirconium silicate, alumina, titania, glass, etc. The bead sizes typically range from 0.25 to 3.0 millimeters (mm) in diameter. The scavenger particles in the dispersion should have mean diameters from 0.01 to 10.0 micrometers (μm) and preferably from 0.05 to 5.0 micrometers (μm). The use of solid particle dispersions in imaging is described, for example, in U.S. Pat. No. 4,006,025 to Swank et al and U.S. Pat. No. 4,940,654 to Diehl et al, which are herein incorporated by reference. Milling techniques are described in for example, U.S. Pat. Nos. 3,008,657 to Szegvari, 3,075,710, to Feld et al and 3,149,789 to Szegvari.

The scavenger compounds can be used in the ways and for the purposes that scavengers for oxidized developing agent are employed in the art. They can be incorporated in a silver halide emulsion layer of the photographic element or in a separate layer of the element. When incorporated in a separate layer, that layer is preferably an interlayer between silver halide emulsion layers although it can be an undercoat layer coated below all of the silver halide emulsion layers or an overcoat layer coated above all of the silver halide emulsion layers. When the scavenger is in a layer between two silver halide layers, the two silver halide layers preferably comprise a coupler that can react with oxidized developer such as a color developer to form or release a photographically useful group. Such photographically useful groups are known in the art and may be groups such as dyes, development modifiers such as development inhibitors, and the like.

The amount of scavenger compound employed will depend upon the particular purpose for which the scavenger is to be used and the degree of scavenging desired. Typically useful results are obtained when the scavenger is employed in an amount of between about 5 and 1000 mg/sq. meter per layer.

The vehicle for the crystalline solid particle dispersion can be essentially any photographic vehicle, such as gelatin and other hydrophilic colloids, or various synthetic polymers such as polyvinyl alcohol or acrylamide polymers. Photographic vehicles commonly employed in silver halide photographic elements are described in *Research Disclosure*, December 1978, Item No. 17643, Section IX, the disclosure of which is incorporated herein by reference.

The photographic elements of the present invention can be simple black-and-white or monochrome elements comprising a support bearing a layer of the silver halide emulsion, or they can be multi-layer and/or multicolor elements. They can be designed for processing with separate solutions or for in-camera processing. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in any desired order. In an alternative format, the emulsion or emulsions can be disposed as one or more segmented layers, e.g., as by the use of microvessels or microcells, as described in U.S. Pat. No. 4,362,806 to Whitmore.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, the element containing a scavenger of this invention. Preferably the scavenger is in an interlayer between silver halide emulsion layers sensitive to the same or different silver halide emulsion layers.

The elements of the present invention can contain additional layers conventional in photographic elements, such as overcoat layers, spacer layers, filter layers, antihalation layers, pH lowering layers (sometimes referred to as acid layers and neutralizing layers), timing layers, opaque reflecting layer, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, December 1978, Item 17643, referred to above. The support can be coated with a magnetic recording layer as discussed in *Research Disclosure* 34390 of November 1992, the disclosure of which is incorporated herein by reference.

The light-sensitive silver halide emulsions employed in the photographic elements of this invention can include coarse, regular or fine grain silver halide crystals or mixtures thereof and can be comprised of such silver halides as silver chloride, silver bromide, silver bromo-iodide, silver chlorobromide, silver chloroiodide, silver chlorobromoiodide, and mixtures thereof. The emulsions can be negative working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 17643, December 1978, and the references listed therein.

The photographic silver halide emulsions can contain other addenda conventional in the photographic art. Useful addenda are described, for example, in *Research Disclosure*, December 1978, Item 17643. Useful addenda include spectral sensitizing dyes and desensitizers, antifoggants, masking couplers, DIR couplers, DIR compounds, anti-stain agents, image dye stabilizers, absorbing materials, coating aids, plasticizers and lubricants, and the like.

Depending upon the dye image-providing material employed in the photographic element, it can be incorporated in the silver halide emulsion layer or in a separate layer associated with the emulsion layer. The dye image-providing material can be any of a number known in the art, such as dye-forming couplers, bleachable dyes, dye developers and redox dye-releasers, and the particular one employed will depend on the nature of the element and the type of image desired.

Dye image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Dye image-providing materials useful in diffusion transfer film units contain a dye moiety and a monitoring moiety. The monitoring moiety, in the presence of an alkaline processing solution and as a function of silver halide development, is responsible for a change in mobility of the dye moiety. These dye image-providing materials can be initially mobile and rendered immobile as a function of silver halide development, as described in U.S. Pat. No. 2,983,606. Alternatively, they can be initially immobile and rendered mobile, in the presence of an alkaline processing solution, as a function of silver halide development. This latter class of materials include redox dye-releasing compounds. In such compounds, the monitoring group is a carrier from which the dye is released as a direct function of silver halide development or as an inverse function of silver halide development. Compounds which release dye as a direct function of silver halide development are referred to as negative-working release compounds, while compounds which release dye as an inverse function of silver halide development are referred to as positive-working release compounds.

The developing agents that can be used to develop the photographic elements of this invention, the oxidized form of which can be reduced by the scavengers of this invention, include hydroquinones, aminophenols, 3-pyrazolidones and phenylene diamines. Some of these developing agents, when used for certain applications, are referred to in the art as electron transfer agents. The particular developing agent employed will depend on the particular type of photographic element to be processed. For example, phenylene diamines are the developers of choice for use with color photographic elements containing dye-forming couplers, while 3-pyrazolidones are preferably used with image transfer materials containing redox dye releasers.

Representative developing agents include: hydroquinone, N-methylaminophenol, 1-phenyl-3 -pyrazolidone, 1-phenyl-4,4-dimethyl-3-pyrazolidone, 1 -phenyl-4-methyl-4-hydroxymethyl-3-pyrazolidone, N,N-diethyl-p-phenylenediamine, 3-methyl-N,N-diethyl-p-phenylenediamine, 3-methoxy-N,N-diethyl-p-phenylenediamine, N,N,N',N'-tetramethyl-p-phenylenediamine.

The following examples illustrate the preparation and use of crystalline solid particle dispersions of oxidized developer scavengers in accordance with this invention and compares such dispersions to conventional oil-in-water dispersions of said scavengers. The specific scavenger used in the examples is of the formula:

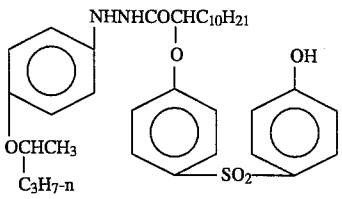

Cpd. 1

The dispersions used in the evaluation were prepared as follows:

Preparation A

A conventional oil-in-water dispersion of a photographically useful hydrazide oxidized developer scavenger, Compound 1, was prepared by dissolving 12.0 g of Compound 1 in 12.0 g of di-n-butylphthalate and 24.0 g of ethyl acetate at 60° C., then combining with an aqueous phase consisting of 16.0 g gelatin, 6.0 g of a 10% solution of a mixture of monomers, dimers, trimers and tetramers of the sodium salt of isopropylnaphthalene sulfonic acid, commercially available as Alkanol-XC from DuPont, and 130.0 g distilled water. The mixture was then passed through a colloid mill 5 times, followed by evaporation of ethyl acetate using a rotary evaporator and replacement with distilled water to yield a dispersion having 6.0% Compound 1 and 8.0% gelatin.

Preparation B

Dispersion B was prepared the same as Dispersion A except 3.0 g N,N-diethyl lauramide was substituted for 12.0 g di-n-butylphthalate, and 139.0 g distilled water was used.

Preparation C

A crystalline solid particle dispersion, Dispersion C, of Compound 1 was prepared by placing 2.4 g of Compound 1 in a 120 ml glass jar containing 18.0 g distilled water, 3.6 g of a 6.7% aqueous solution of octylphenoxy ethylene oxide sulfonate, commercially available as TX200 from Rohm and Haas, and 60 ml of 1.8 mm zirconium oxide beads. The jar was placed on a SWECO vibratory mill for 5 days. The milled slurry was mixed with gelatin and water to yield a dispersion containing 5% Compound 1 and 7% gelatin.

Preparation D

Dispersion D, a conventional oil-in-water dispersion of Compound 1, was prepared the same as Dispersion A except 6.0 g di-n-butylphthalate and 136.0 g distilled water were used.

Preparation E

Dispersion E was prepared the same as Dispersion D except tricresylphosphate was substituted for di-n-butylphthalate.

The oxidized developer scavenger dispersions were evaluated for particle growth as set forth below.

EXAMPLE 1

In this example, Compound 1 was dispersed as an oil-in-water dispersion as both Dispersion D and Dispersion E, and as a crystalline solid particle dispersion as Dispersion C. All dispersions were held for 24 hours at 45° C., and the particle size of each dispersion was measured by near infrared turbidimetry before and after the holding period. Table I gives the particle size in results, in microns, of the dispersions of Compound 1 before and after the holding period.

TABLE I

| Sample | t = 0 mean particle size (μm) | t = 24 hrs at 45° C. mean particle size (μm) |
|---|---|---|
| Dispersion D (prior art) | 0.1374 | 0.1721 |
| Dispersion E (prior art) | 0.1431 | 0.2097 |
| Dispersion C (invention) | 0.0858 | 0.1021 |

Results from Table I show that the crystalline solid particle dispersion of Compound 1 is not only finer in size initially, but also exhibits significantly less particle growth than the prior art.

The oxidized developer dispersions were evaluated as set forth below in color negative photographic materials prepared, exposed and processed according to conventional procedures. Multilayer films were prepared, each comprising three color records separated by one or more interlayers, each of which contains a dispersion of oxidized developer scavenger. The purpose of the interlayer is to prevent oxidized developer generated in one of the color layers from affecting any chemical reactions in another color layer. The following compounds were used in preparing the multilayer film structures set forth below.
Cpd. 2
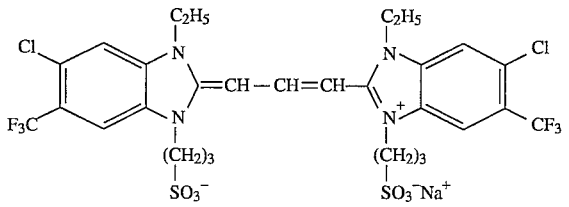
Cpd. 3
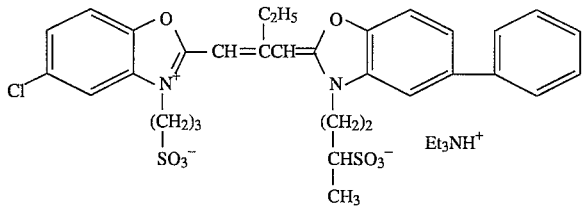
Cpd. 4
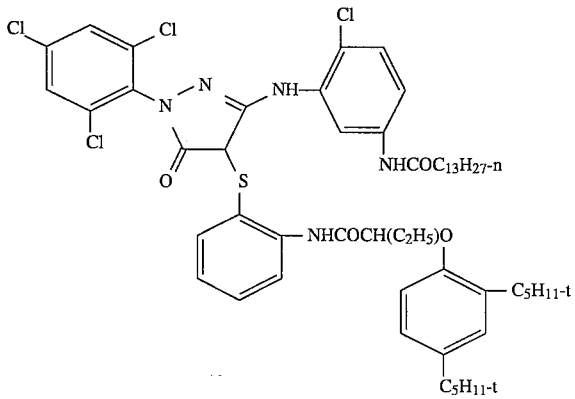
Cpd. 5
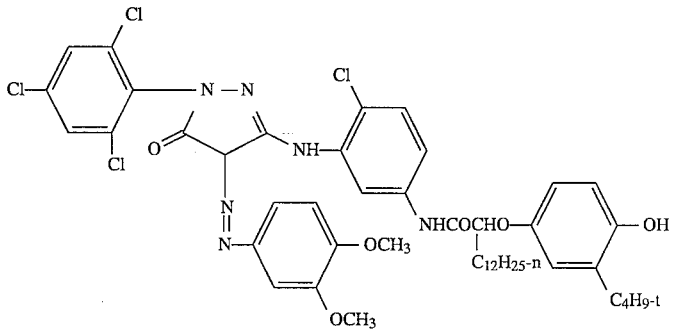
Cpd. 6
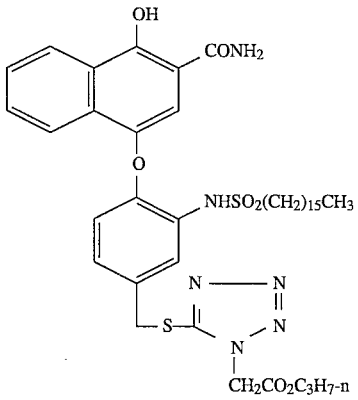

-continued
Cpd. 7
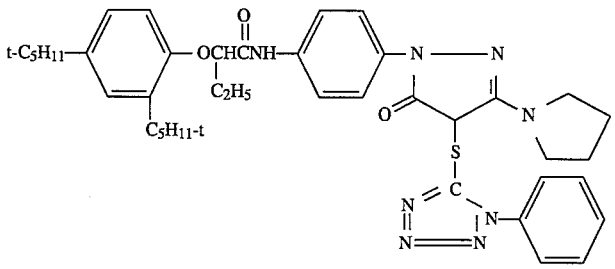
Cpd. 8
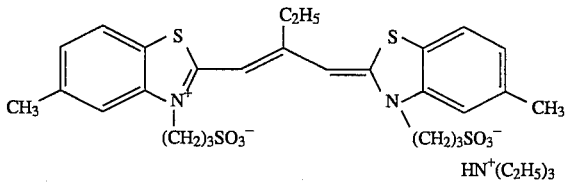
Cpd. 9
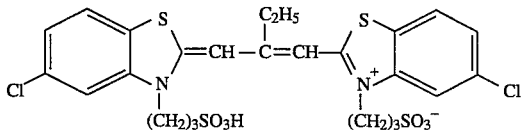
Cpd. 10
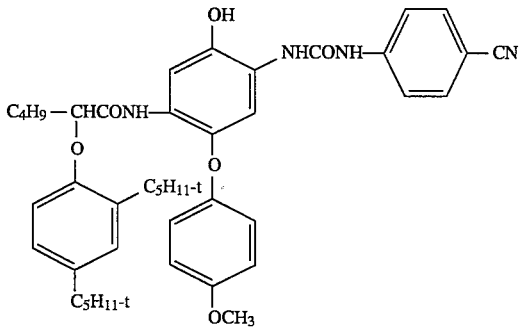
Cpd. 11
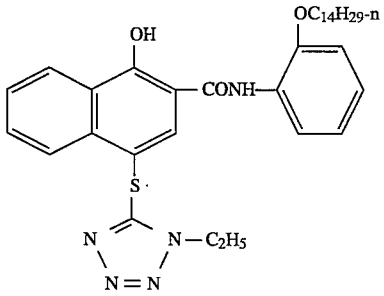
Cpd. 12
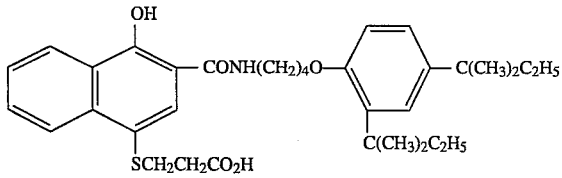
Cpd. 13
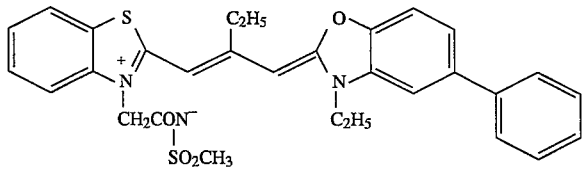

EXAMPLE 2

In this example, the oxidized developer scavenger Compound 1, dispersed as a crystalline solid particle dispersion, Dispersion C, is compared a conventional dispersion of Compound 1, Dispersion B. For purposes of comparison, multilayer films were prepared in which red- and green-sensitive layers were separated by an interlayer that contained the dispersions as described below.

More specifically, the multilayer photographic film used as a COMPARISON in this example contained, inter alia, the following layers and materials:

GREEN SENSITIVE LAYER:

AgBrI tabular grain emulsion, 3.4% I, 2.31×0.125 μm, sensitized with cpd 3 & 13 at 0.84 mmole/Ag mole, 0.4166 g/m$^2$.

AgBrI tabular grain emulsion, 4.1% I, 0.80×0.09 μm, sensitized with dyes cpd 2 & 3, 0.87 mmole/Ag mole, 0.4790 g/m$^2$.

magenta dye forming coupler cpd 4, 0.2562 g/m$^2$ magenta dye forming coupler cpd 5, 0.0804 g/m$^2$ non color forming coupler cpd 6, 0.0027 g/m$^2$ magenta dye forming coupler cpd 7, 0.0048 g/m$^2$ gelatin, 1.2917 g/m$^2$

INTERLAYER oxidized developer scavenger (Dispersion B), 0.0538 g/m$^2$ gelatin 0.9688 g/m$^2$

RED SENSITIVE LAYER

AgBrI tabular grain emulsion, 3.4% I, 3.77×0.12 μm, sensitized with cds 8 & 9, 0.82 mmole/Ag mole, 1.2379 g/m$^2$ cyan dye forming coupler cpd 10, 0.2368 g/m$^2$ cyan dye forming DIR coupler cpd 11, 0.0463 g/m$^2$ cyan dye forming coupler cpd 12, 0.0027 g/m$^2$ gelatin, 1.8514 g/m$^2$ A multilayer film of this invention, INVENTION 2-1 was prepared in the same manner as the COMPARISON, except that in the interlayer, the conventional dispersion, Dispersion B of Compound 1, is replaced with a crystalline solid particle dispersion Dispersion C of Cpd. 1 (0.0538 g/square meter).

A multilayer film of this invention INVENTION 2-2 was prepared in the same manner as the COMPARISON, except that in the interlayer, the conventional dispersion Dispersion B of Compound 1, is replaced with a crystalline solid particle dispersion Dispersion C of Compound 1 (0.0807 g/square meter).

The photographic film elements were tested for the ability the interlayer formulation to prevent color contamination as follows:

The scavenging ability of each interlayer formulation may be determined by the following method. The multilayer containing interlayers formulated with the control, comparison or invention dispersions is exposed to red or green light only. The exposed color record is the only layer that develops and is designated the "causer" layer. Any other color records, which are not developing, are designated "receiver" layers. The only way for color density to change in a receiver layer is for oxidized developer from the causer layer to diffuse through the interlayer to the receiver layer. Differences in the density in a receiver layer indicate differences in the effectiveness of the scavenger in reacting with oxidized developer and preventing color contamination.

The results are reported in Table II. The data shown in Table II demonstrate that Dispersion C used in this example is equally or more effective than the COMPARISON Dispersion.

TABLE II

| Sample | Oxidized Developer Scavenger | Red Causer Green Receiver | Green Causer Red Receiver |
|---|---|---|---|
| Comparison | Dispersion B[a] | 0.138 | 0.589 |
| Invention 2-1 | Dispersion C[b] | 0.138 | 0.581 |
| Invention 2-2 | Dispersion C[b] | 0.146 | 0.567 |

[a]Two other interlayers in the multilayer film element contained conventional dispersion of Compound 1, Dispersion A. One other interlayer in the multilayer film element contained Dispersion B.
[b]Three other interlayers in the multilayer film element contained Dispersion C.

The invention has been described in detail with particular reference to preferred embodiments thereof, but it is to be understood that variations and modifications can be effected within the spirit and scope of the invention.

What is claimed is:

1. A photographic element comprising a support having thereon at least one silver halide emulsion layer, and a layer, which is the same or different from the silver halide layer, comprising hydrazide oxidized developer scavenger dispersed in a binder, wherein the dispersed hydrazide oxidized developer scavenger consists essentially of hydrazides in solid particle crystalline form.

2. A photographic element according to claim 1, wherein the hydrazide oxidized developer scavenger has the formula

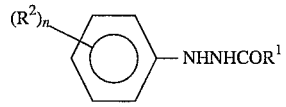

wherein:

$R^1$ represents an electron donating group;

$R^2$ represents a hydrogen atom or an alkyl, alkoxy, aryl, aryloxy, aralkyl or amino group; and n is an integer from 1 to 5.

3. A photographic element according to claim 2, wherein the hydrazide oxidized developer scavenger has the formula:

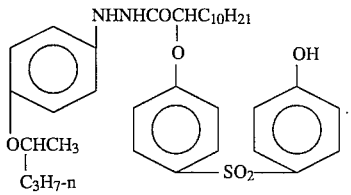

4. A photographic element according to claim 1, wherein the dispersed hydrazide oxidized developer scavenger is formed by a process comprising the steps of:

(a) milling a crystalline solid hydrazide oxidized developer scavenger in an aqueous medium in the presence of a dispersing agent and in the substantial absence of an organic solvent to form a first dispersion; and (b) adding the first dispersion to an aqueous medium comprising a binder to for a second dispersion.

5. A photographic element according to claim 4, wherein the dispersing agent is an anionic, nonionic or zwitterionic surfactant, a water soluble homopolymer or copolymer, or mixtures thereof.

6. A photographic element according to claim 1, prepared by a process which comprises the steps of:

(a) milling a crystalline solid hydrazide oxidized developer scavenger in an aqueous medium in the presence of a dispersing agent and in the substantial absence of an organic solvent to form a first dispersion;

(b) adding the first dispersion to an aqueous medium comprising a binder to form a second dispersion; and (c) coating the second dispersion onto a support.

* * * * *